US008074374B2

(12) United States Patent
Chang

(10) Patent No.: US 8,074,374 B2
(45) Date of Patent: Dec. 13, 2011

(54) SHOE SOLE WITH VENTILATION

(75) Inventor: Chiu Wang Chang, Taipei (TW)

(73) Assignee: Victoria Shoes Co., Ltd., Taipei (TW)

( * ) Notice: Subject to any disclaimer, the term of this patent is extended or adjusted under 35 U.S.C. 154(b) by 503 days.

(21) Appl. No.: 12/398,525

(22) Filed: Mar. 5, 2009

(65) Prior Publication Data

US 2010/0223817 A1 Sep. 9, 2010

(51) Int. Cl.
*A43B 7/08* (2006.01)

(52) U.S. Cl. ..... 36/3 B

(58) Field of Classification Search ..... 36/3 R, 36/3 A, 3 B, 25 R, 29, 37, 35 B
See application file for complete search history.

(56) References Cited

U.S. PATENT DOCUMENTS 2,441,879 A * 5/1948 Gantt ..... 36/3 R
5,138,775 A * 8/1992 Chu ..... 36/3 B
5,477,626 A * 12/1995 Kwon ..... 36/3 B
5,975,861 A * 11/1999 Shin et al. ..... 417/234
6,305,099 B1 * 10/2001 Chu ..... 36/3 B
7,082,696 B2 * 8/2006 Wu ..... 36/3 B
7,681,329 B2 * 3/2010 Fu ..... 36/3 B
2007/0000148 A1 * 1/2007 Lin et al. ..... 36/3 B
2007/0011908 A1 * 1/2007 Huang et al. ..... 36/3 B
2007/0294923 A1 * 12/2007 Hayakawa ..... 36/3 B
2008/0313930 A1 * 12/2008 Lee ..... 36/3 B
2009/0151203 A1 * 6/2009 Boyer et al. ..... 36/3 B
2009/0282704 A1 * 11/2009 Park ..... 36/3 B

* cited by examiner

*Primary Examiner* — Jila Mohandesi

(57) ABSTRACT

A shoe sole includes an insole having front vent holes; and an outsole comprising a heel comprising an open cavity, a first check valve extending from the cavity to the external, and a flexible protrusion on the heel bottom; a cover fitted on the cavity and comprising grooves and a second check valve communicating with the grooves and the cavity; front projections on the outsole top; and a channel on the arch top. Foot stepping will compress the protrusion to close the first check valve and open the second check valve such that air within the cavity is expelled to a sole of the foot via the second check valve, the grooves, the channel, and the vent holes. Foot lifting will return the protrusion to its original shape with the first check valve open and the second check valve closed so as to draw air into the cavity.

4 Claims, 9 Drawing Sheets

SHOE SOLE WITH VENTILATION

BACKGROUND OF THE INVENTION

1. Field of Invention

The invention relates to shoes with ventilation structure and more particularly to a shoe sole having an improved ventilation structure.

2. Description of Related Art

Typical footwear often has a drawback of reduced ventilation because confining the foot usually does not allow sufficient breathability. Hence, it may cause the foot to perspire and may also promote the development of bacteria or like as well as unpleasant odors and skin problems. Thus, later developed footwear attempted to solve the lack of sufficient breathability by ventilating the shoe. For example, U.S. Pat. No. 6,305,100 discloses a shoe ventilation.

A conventional shoe sole having a cushion structure is shown in FIG. 1. The sole comprises an insole A, an outsole B having a recess B2 on the heel B1, and a padded block C fitted in the recess B2. The conventional shoe attempted to absorb shock while walking. However, it does not increase breathability. In fact, fresh atmospheric air drawn into the shoe through the gap between the block C and the recess B2 is greatly insufficient and to the worse hot air within the shoe still cannot be exited. Thus, the need for improvement still exists.

SUMMARY OF THE INVENTION

It is therefore one object of the invention to provide a shoe sole having a ventilation structure.

The above and other objects, features and advantages of the invention will become apparent from the following detailed description taken with the accompanying drawings.

DETAILED DESCRIPTION OF THE INVENTION

Figure 1:
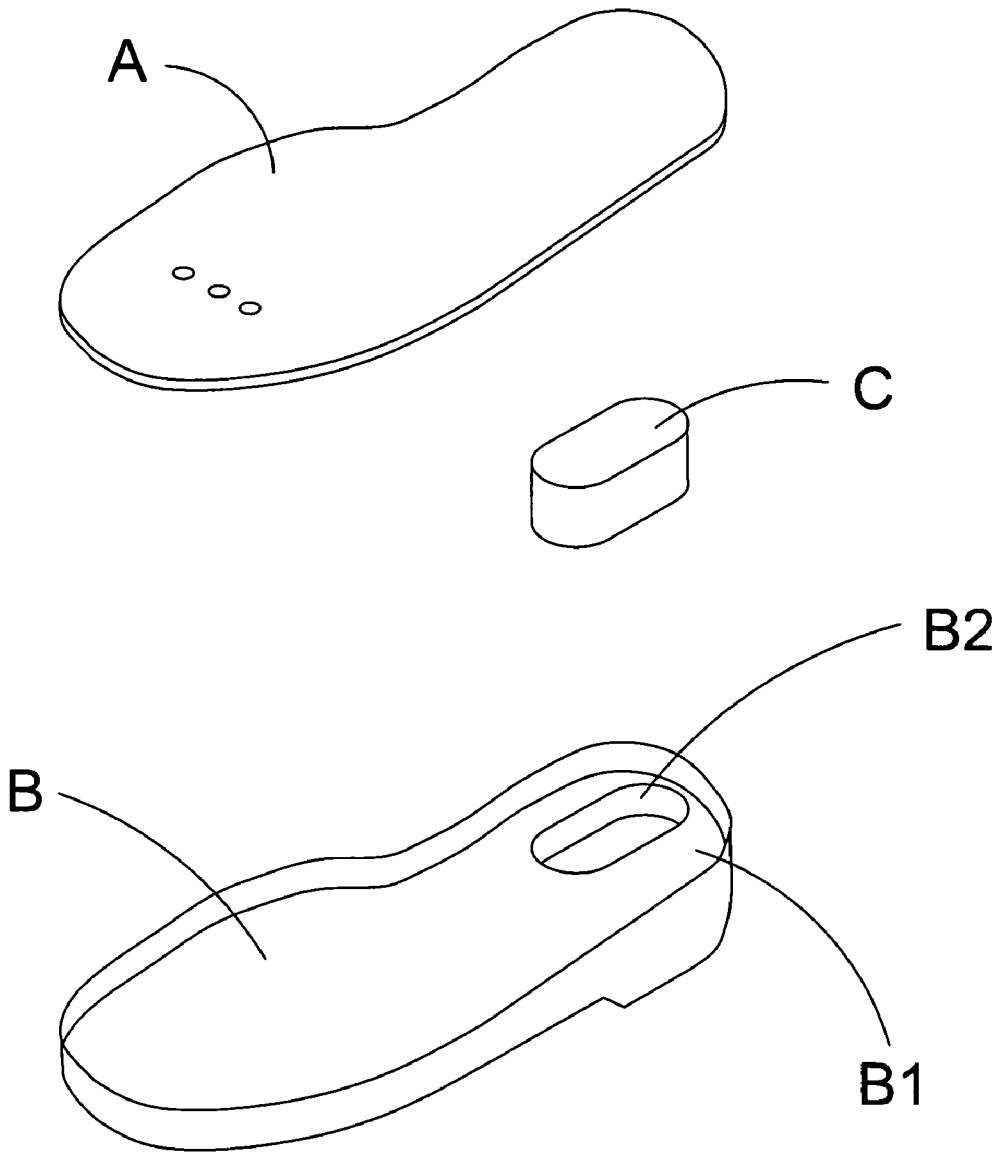
FIG.1(Prior Art)
FIG. 1 is an exploded view of a conventional shoe sole having a cushion structure.
Figure 2:
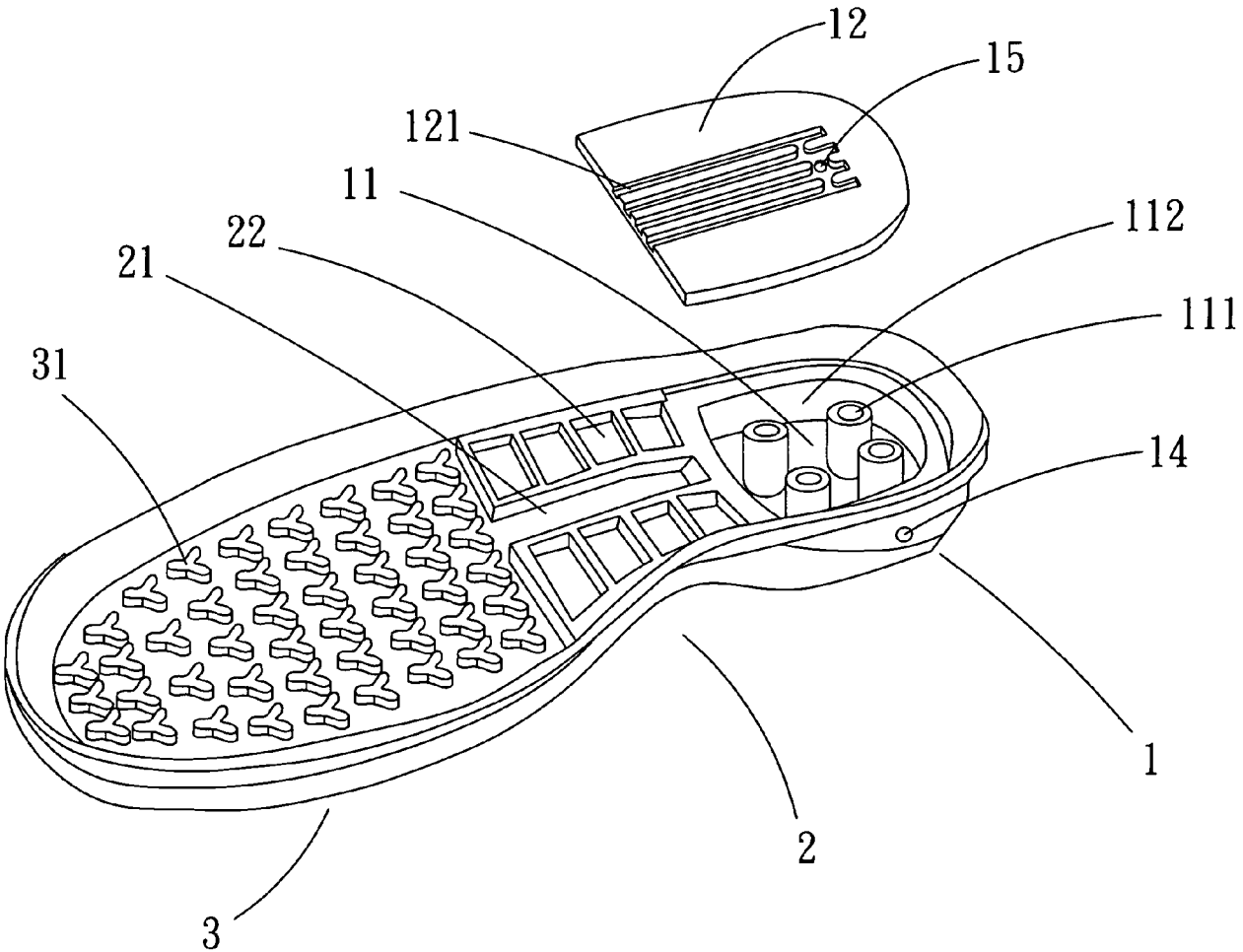
FIG. 2 is an exploded view of a shoe outsole according to the invention.
Figure 3:
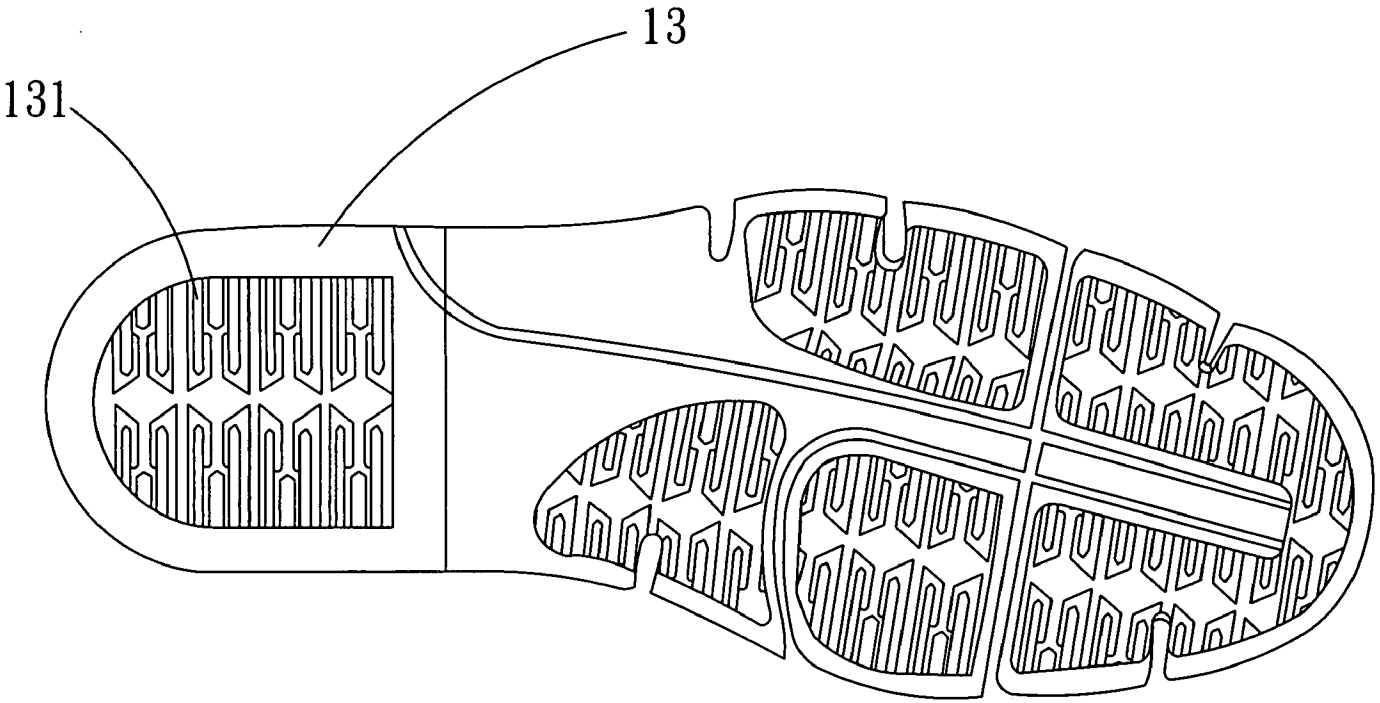
FIG. 3 is a bottom view of the outsole of FIG. 2.
Figure 4:
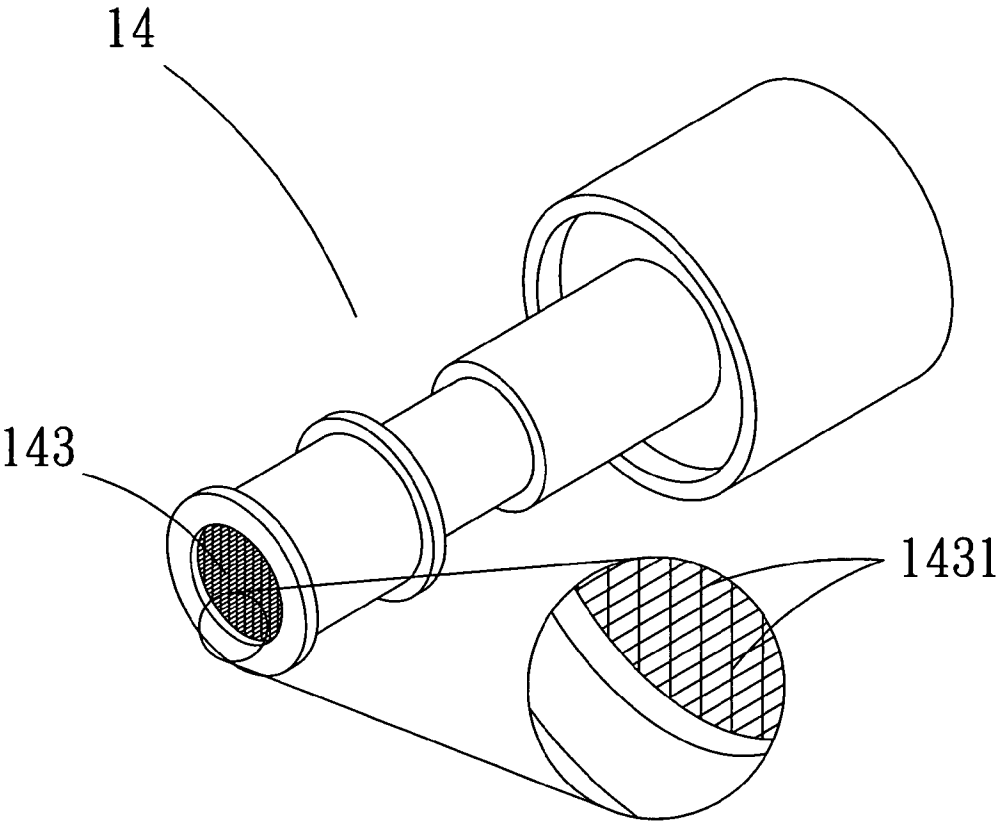
FIGS. 4 and 5 are perspective and cross-sectional views of the first check valve of FIG. 2 respectively.
Figure 5:
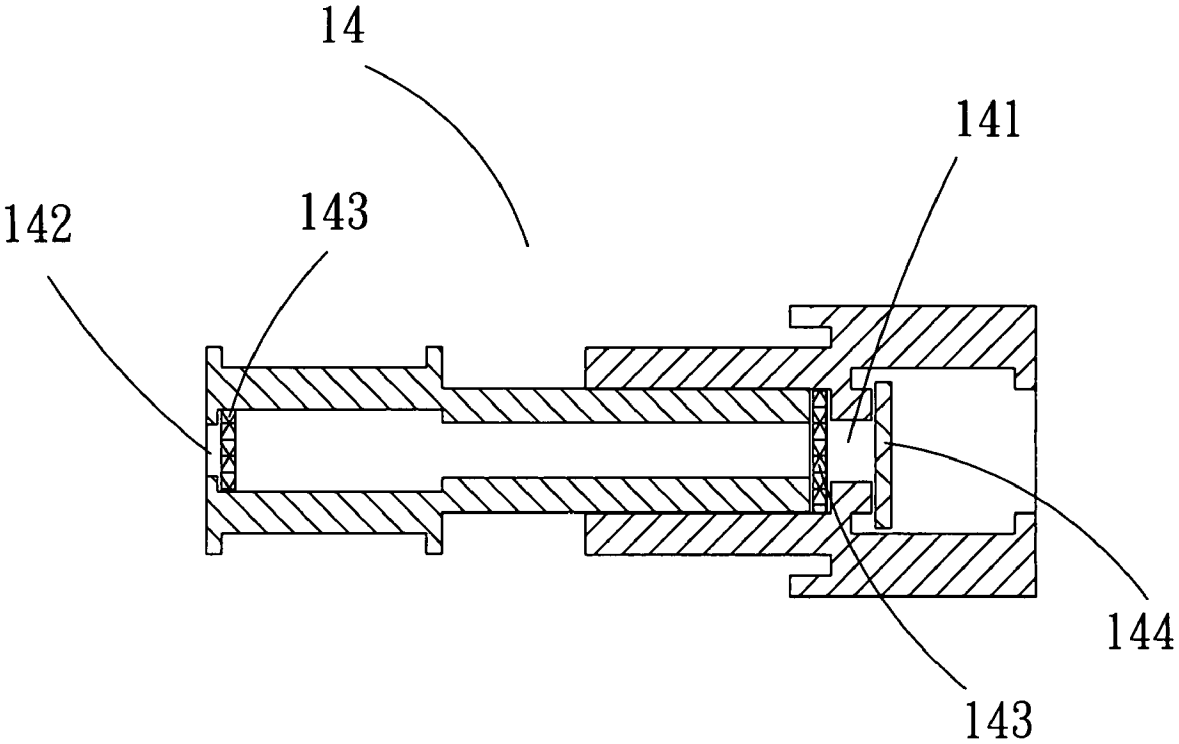
Figure 6:
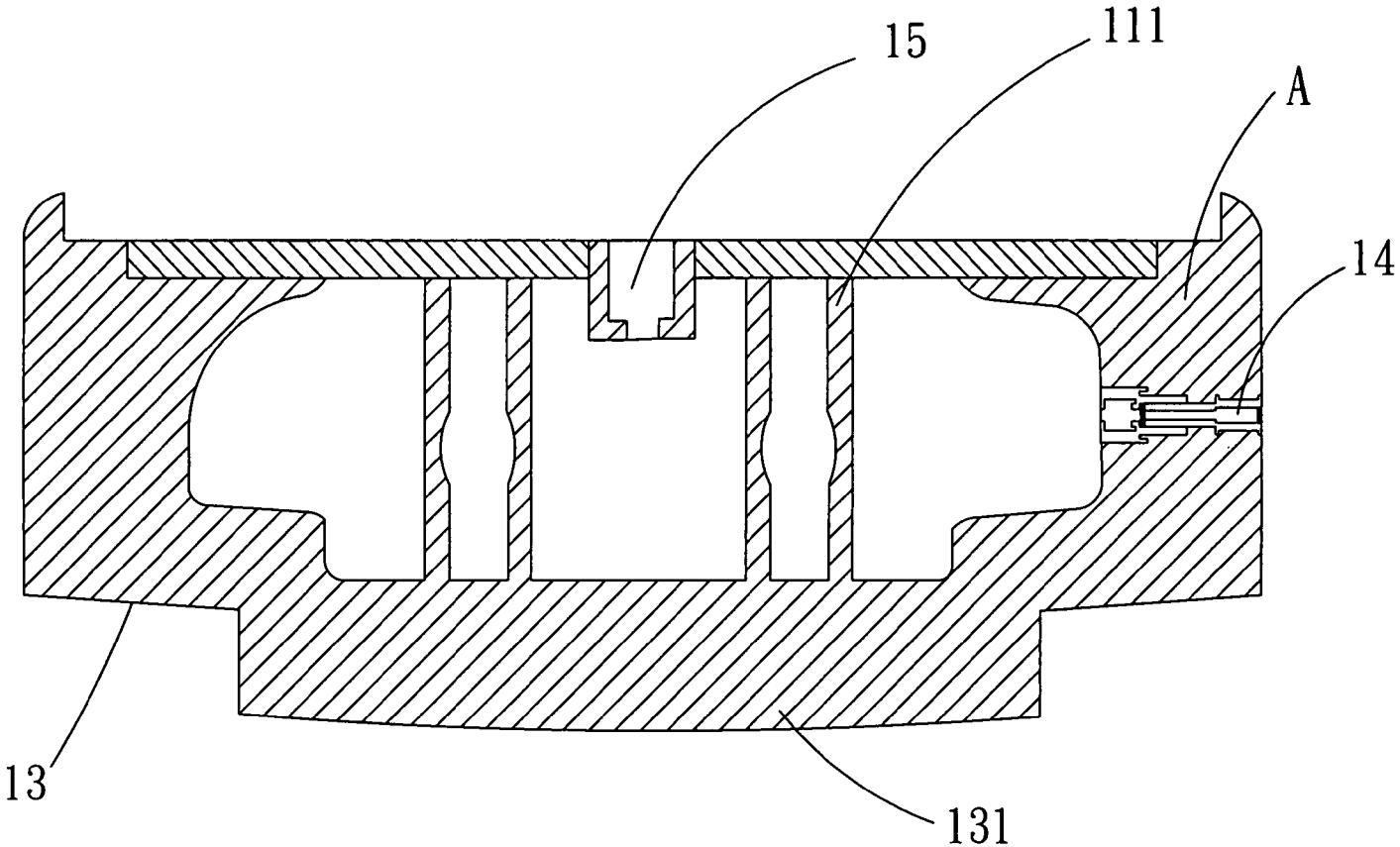
FIG. 6 is a longitudinal view of the heel of the assembled outsole of FIG. 2.
Figure 7:
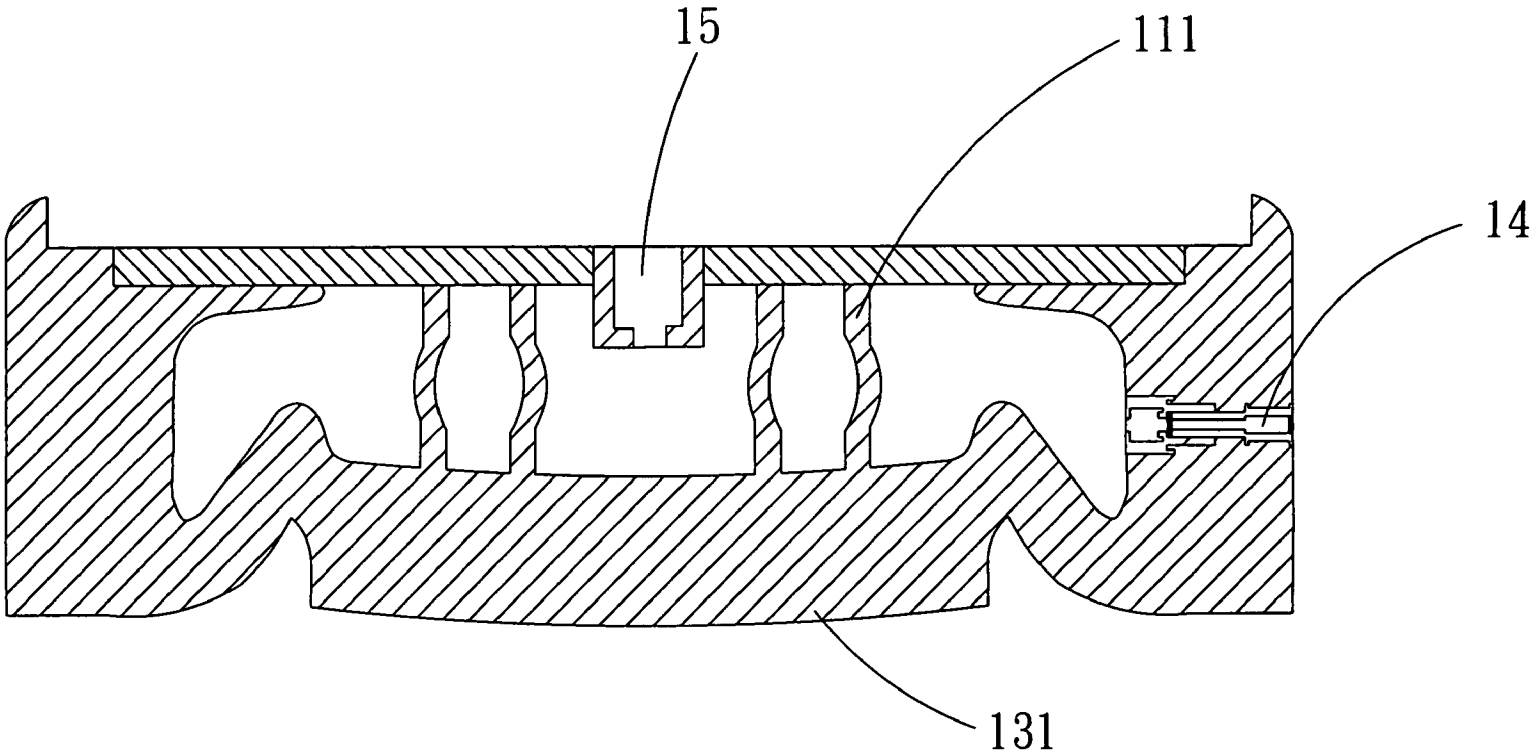
FIG. 7 is a view similar to FIG. 6 where the heel bottom is elastically deformed in response to a wearer's foot pressing hardly thereon.
Figure 8:
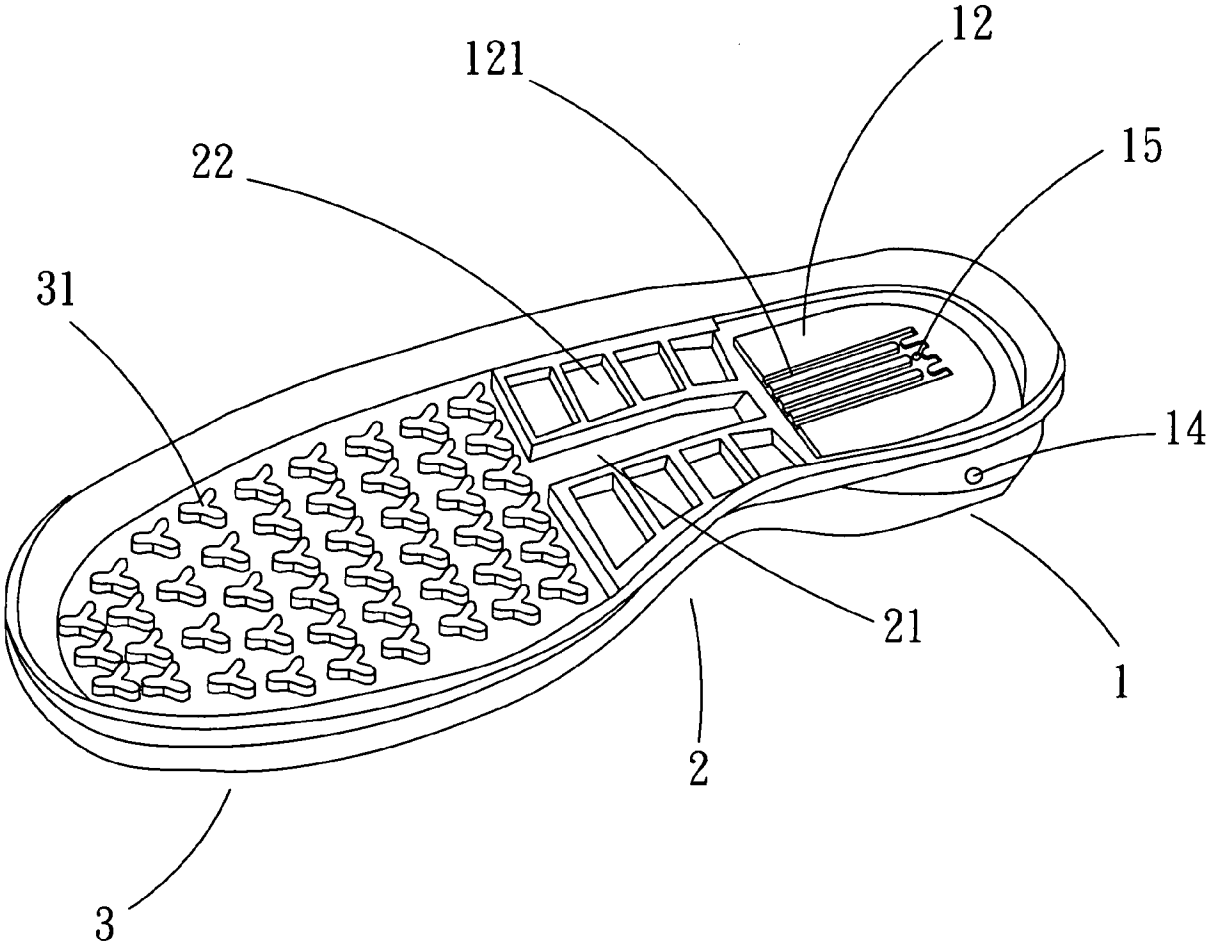
FIG. 8 is a perspective view of the assembled outsole of FIG. 2.
Figure 9:
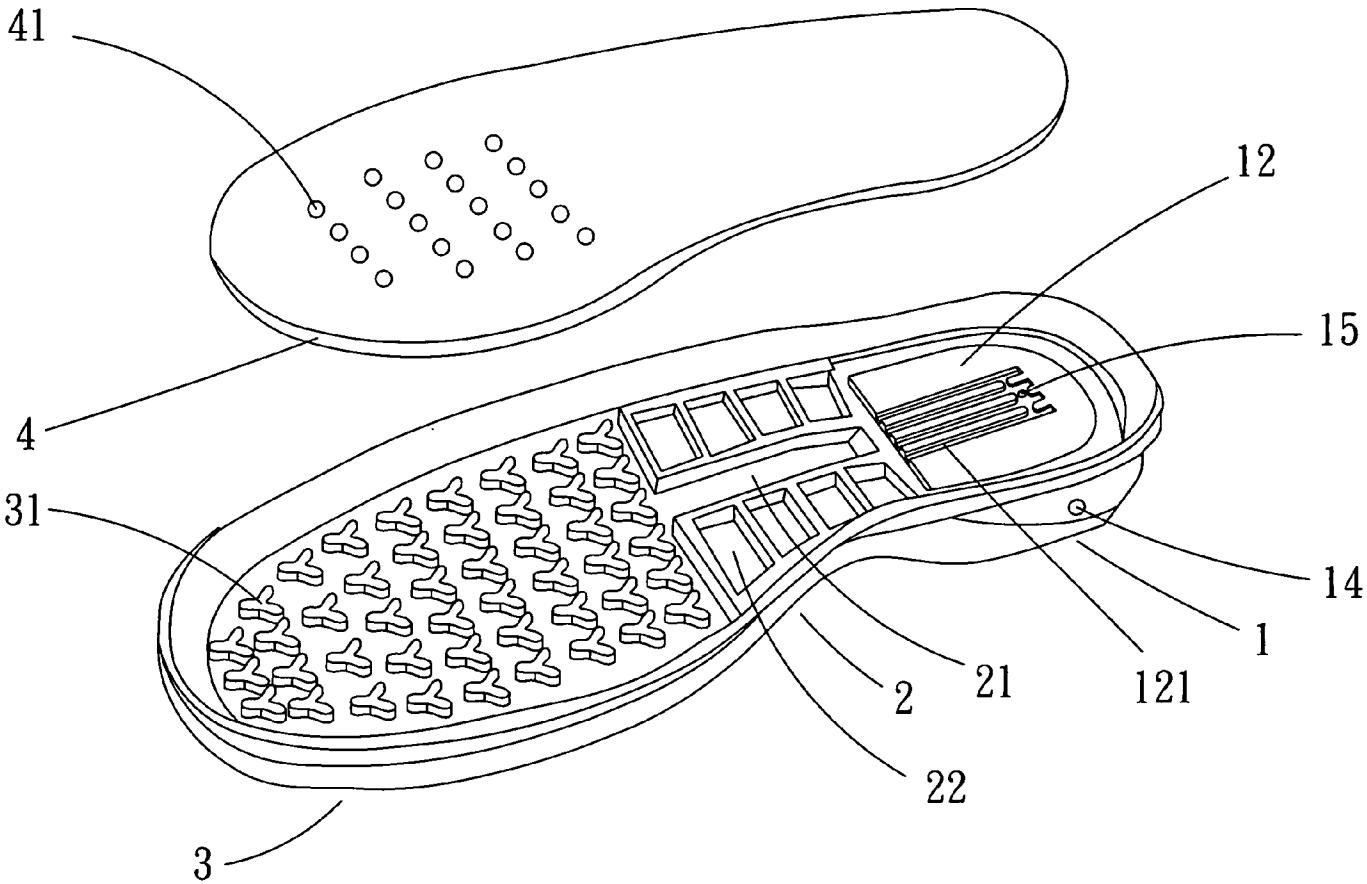
FIG. 9 is an exploded perspective view of the outsole of FIG. 8 to be assembled with an accompanying insole.

Referring to FIGS. 2 to 9, a shoe sole in accordance with the invention comprises an outsole (not numbered) comprising a heel 1, an arch 2, and a front part 3, and an insole 4 as discussed in detail below.

The arch 2 comprises an elongated, lengthwise, central channel 21 on the top, and a plurality of (four) small compartments 22 on either side of the channel 21 in which the channel 21 has a forward opening at a rear end of the top of the front part 3. The front part 3 comprises a plurality of Y-shaped projections 31 on the top.

The heel 1 comprises a substantially rectangular, cavity 11 and a cover 12 releasably fitted on the enlarged mouth of the cavity 11. A flexible protrusion 131 is formed on the bottom 13 of the heel 1. The height of the protrusion 131 is relatively low. Thus, a person may not feel uncomfortable due to the provision of the protrusion 131 when wearing the shoe. The cover 12 comprises a plurality of (four) elongated, lengthwise grooves 121. A second check valve 15 has top and bottom openings in communication with a transverse trough (not numbered) interconnecting the grooves 121 and the cavity 11 respectively. A plurality of (four) holed support posts 111 arranged as a square are provided on the cavity 11, the support post 111 being formed of rubber.

A first check valve 14 is provided on the left side of the outsole and has one end open to a wall 112 of the cavity 11 and the other end open to the other side surface of the heel 1. The first check valve 14 is made of plastic, is a tubular member, and has a staggered contour. The first check valve 14 comprises a bore 141, a narrow inlet 142 of decreased diameter, the inlet 142 being open to the other side surface of the heel 1, a hinged disc 144 of plastic mounted at a distal portion of the bore 141 proximate the cavity 11, and two meshes 143 having a plurality of connected strands 1431 of flexible material to form a plurality of closely-spaced holes, one mesh 143 being provided on a shoulder adjacent the inlet 124 and the other mesh 143 being provided proximate the disc 144.

Referring to FIGS. 6 to 9 specifically, the ventilation function of the invention will be described in detail below. An insole 4 can be placed on the outsole. The insole 4 has a plurality of vent holes 41 on its front portion. The vent holes 41 are adapted to communicate with the space formed by island-like projections 31.

The protrusion 131 is compressed upward when a wearer's foot wearing the shoe puts the most pressure down on the cover 12 in a stepping action of walking. And in turn, the support posts 111 are elastically bent and the space of the cavity 11 is reduced. The pressurized air within the cavity 11 forces the second check valve 15 to open. Also, this forms a mechanism that expels air from within the cavity 11 to a sole of the foot via the second check valve 15, the grooves 121, the channel 21, the space around the projections 31, and the vent holes 41. At about the same time, the disc 144 is closed automatically because the air pressure within the cavity 11 is greater than the atmospheric pressure. The closed disc 144 thus can prevent air within the cavity 11 from exiting out of the first check valve 14.

The protrusion 131 is expanded downward to return to its original shape when the person lifts his or her foot in a lifting action of walking. And in turn, both the support posts 111 and the cavity 11 return to its original shape. The air pressure within the cavity 11 decreases sharply. This means that the air pressure within the cavity 11 is less than the atmospheric pressure. Further, this forms a mechanism that draws fresh atmospheric air into the cavity 11 via the open first check valve 14. At about the same time, the second check valve 15 is closed automatically because air pressure at its inlet (i.e., air pressure within the cavity 11) is less than that at its outlet (i.e., at the grooves 121). This can prevent air within the cavity 11 from exiting out of the second check valve 15.

A ventilation effect to the sole is carried out by repeating the stepping and lifting actions of the foot in walking. As a result, breathability of the shoe greatly increases and unpleasant odors no longer exist.

The invention further has the following advantages and benefits. The protrusion 131 further serves as a cushion. The meshes 143 can prevent debris and water from entering the shoe. The Y-shaped projections 31 can provide support to the front part of the shoe sole. The support posts 111 can provide resilient support to the sole heel. A person wearing the shoes of the invention can feel a degree of comfort when walking.

While the invention herein disclosed has been described by means of specific embodiments, numerous modifications and variations could be made thereto by those skilled in the art without departing from the scope and spirit of the invention set forth in the claims.

What is claimed is:

1. A shoe sole comprising:

an insole having a plurality of vent holes on the front part; and an outsole comprising a heel comprising a cavity open to the top, a plurality of flexible support posts on the cavity, a lateral first check valve extending from the cavity to one side of the heel, and a flexible protrusion on the bottom of the heel; a cover releasably fitted on the cavity, the cover comprising a plurality of lengthwise grooves and a second check valve communicating with the grooves and the cavity; a plurality of spaced projections on the front part of the top of the outsole, a space below the front part of the insole with the projections being disposed therein; and a lengthwise, central channel communicating the grooves and the space;

wherein in response to a wearer's foot stepping on the shoe sole the protrusion is compressed upward to compress both the cavity and the support posts, close the first check valve, and open the second check valve such that air within the cavity is adapted to expel to a sole of the foot via the second check valve, the grooves, the channel, the space, and the vent holes; and wherein in response to the wearer's foot lifting the shoe sole each of the protrusion, the cavity, and the support posts returns to its original shape with the first check valve being open and the second check valve being closed such that atmospheric air is adapted to draw into the cavity via the first check valve.

2. The shoe sole of claim 1, wherein the first check valve comprises a first mesh proximate one side of the heel, and a second mesh proximate the cavity.

3. The shoe sole of claim 1, wherein the projections are Y-shaped.

4. The shoe sole of claim 1, wherein the support posts are holed.

* * * * *